United States Patent [19]

Peele

[11] 4,232,921

[45] Nov. 11, 1980

[54] DRAWER SUSPENSION ASSEMBLY

[75] Inventor: David L. Peele, Kernersville, N.C.

[73] Assignee: Miller Desk, High Point, N.C.

[21] Appl. No.: 968,255

[22] Filed: Dec. 11, 1978

[51] Int. Cl.[3] ..... A47B 88/00; F16C 21/00

[52] U.S. Cl. ..... 312/350; 312/257 SK; 312/330 R; 312/338; 312/348; 308/3.6

[58] Field of Search ..... 312/348, 330 R, 338, 312/337, 341, 341 NR, 339, 350, 257 SK, 257 A, 257 SM; 308/3.6; 248/205 A

[56] References Cited

U.S. PATENT DOCUMENTS

| | | | |
|---|---|---|---|
| 781,530 | 1/1905 | Jespersen | 312/338 |
| 1,039,548 | 9/1912 | Kral | 312/348 |
| 1,071,006 | 8/1913 | Little | 308/3.6 |
| 1,508,259 | 9/1924 | Stafford | 312/348 |
| 2,572,081 | 10/1951 | Wallance | 312/257 SK |
| 2,726,915 | 12/1955 | Schuette | 312/337 |
| 3,059,986 | 10/1962 | Miller, Jr. | 308/3.6 |
| 3,061,395 | 10/1962 | Marateck et al. | 312/350 |
| 3,124,401 | 3/1964 | McClellan | 312/339 |
| 3,664,716 | 5/1972 | Johnson | 312/348 |
| 3,697,140 | 10/1972 | Livingston | 312/348 |
| 3,918,668 | 11/1975 | Thorpe | 248/205 A |
| 4,042,288 | 8/1977 | Litchfield | 312/330 R |

*Primary Examiner*—Victor N. Sakran

[57] ABSTRACT

This invention relates to an assembly for supporting a drawer in a desk or cabinet wherein the drawer is provided with C-shaped guide channels recessed in grooves provided in the drawer side walls. The channels cooperate with guide rollers positioned at preselected locations upon mounting plates which, in turn, are secured to a cabinet structure.

3 Claims, 2 Drawing Figures

DRAWER SUSPENSION ASSEMBLY

BACKGROUND, BRIEF SUMMARY AND OBJECTS OF THE INVENTION

This invention relates generally to a drawer suspension assembly, and more particularly to improvements directed to the construction of a suspension mechanism and the installation and positioning of the mechanism between a drawer and a cabinet structure.

It has been a traditional approach to provide telescoping slide assemblies at each side of a drawer, as taught for example by U.S. Pat. Nos. 3,124,401 to McClellan and U.S. Pat. No. 3,059,986 to Miller, or to provide pairs of interconnecting channel members extending substantially the full length of the drawer with one channel of each pair secured to the exterior surface of a drawer side wall and the other channel member secured to structural members of a desk or cabinet. In many instances, the channel members mounted upon the drawer side walls have inwardly turned portions secured to the drawer front.

The present invention provides for securely positioning channel members within recesses or grooves formed in the side walls of each drawer with the channel members being supported by and displaceable along selectively spaced rollers mounted upon elongated plates attached to the cabinet or support structure of a desk or cabinet. The channel members extend a substantial distance beyond the back wall of the drawer thus providing for extra travel of the drawer outwardly of the cabinet structure.

One of the primary objects of the invention is the provision of a new and improved drawer suspension assembly.

Another object of the invention is the provision of a suspension system which is practical, sturdy, simple, and which is readily adaptable to standard cabinet and desk construction.

Still another object of the invention is the provision of a drawer suspension system which has strength and rigidity while requiring less materials, thus resulting in reduced costs.

A further object of the invention is the provision of a compact, quiet and smooth operating assembly which provides maximum drawer width.

Other objects and advantages of the invention will become apparent when considered in view of the following detailed description and the accompanying drawings.

DETAILED DESCRIPTION OF THE INVENTION

While the invention will be described in conjunction with the mounting of drawers within a desk pedestal or cabinet structure, it is to be understood that the suspension system can be utilized equally well in other cabinets or articles of furniture provided with drawers.

Figure 1:
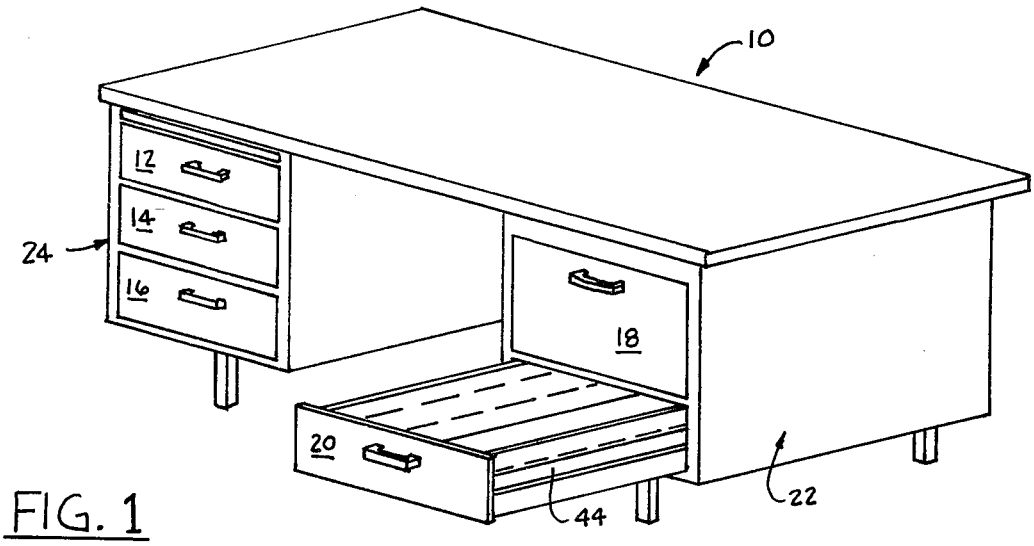
FIG. 1 is a front perspective view of a desk having a drawer partially extended and illustrating the support channels recessed within and attached to the side walls of a drawer.

Referring to the drawing, and particularly to FIG. 1, there is illustrated a desk generally indicated by the reference character 10 having a plurality of drawers 12–20 slidably supported within right and left pedestals 22 and 24.

Figure 2:
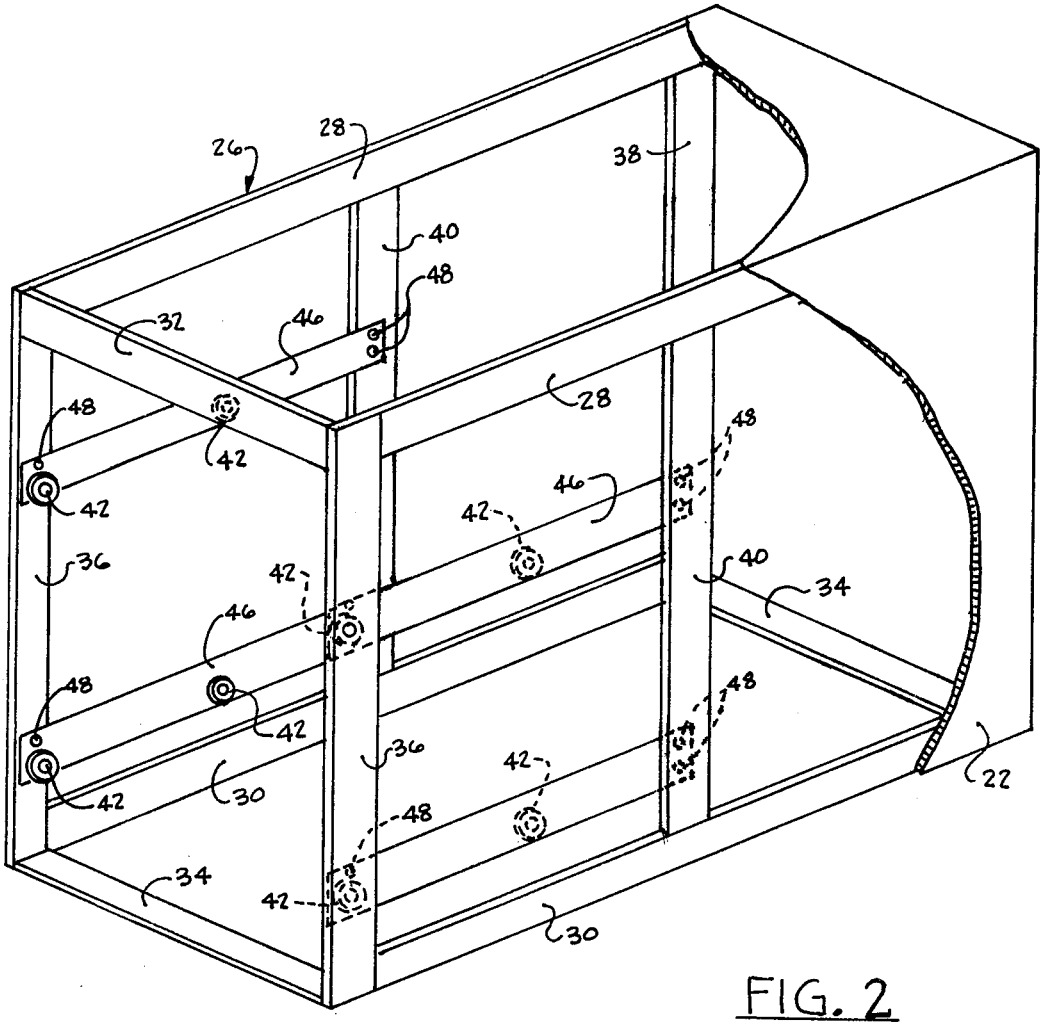
FIG. 2 is an enlarged, fragmentary, perspective view of the desk cabinet or support structure illustrating the location of the mounting plates and support rollers for receiving two drawers, for example, the drawers shown on the right side of the desk of FIG. 1.

FIG. 2 illustrates the cabinet structure or framework 26 of the right pedestal 22 of desk 10 which includes horizontally disposed, parallel, top and bottom side rails 28 and 30, respectively, and top and bottom end rails 32 and 34, respectively, all secured to front and rear vertical rails 36 and 38, and intermediate vertical stretchers 40. The rails and stretchers are secured together in a conventional manner. The positioning of the stretchers 40 intermediate rails 36 and 38 may vary somewhat, however, in a preferred embodiment, the stretchers 40 are secured midway between the rails 36 and 38.

A series of supporting and guiding rollers 42 are supported by the framework 26 for cooperating with the channel members 44 recessed within the drawer side walls. The rollers 42 are attached by stub shafts in a conventional manner to vertical side portions of relatively thin, horizontally disposed mounting plates 46. Preferably, the rollers are of plastic construction supported by frictionless ball bearings.

The mounting plates 46, in the preferred embodiment, extend from the front vertical rails 36 to the intermediate stretchers 40, and are fastened thereto by screws 48 or other suitable securing means. While the positioning of the rollers 42 may vary along the length of the mounting plates 46, depending upon the particular sizes and constructions of the drawer and desk cabinet structure 26, the required degree of drawer travel, etc., in the preferred embodiment, one roller 42 is attached to each mounting plate 46 adjacent a front rail 36, and another roller 42 is attached to each plate 46 approximately midway of the length of the plate as shown by FIG. 2.

Figure 4:
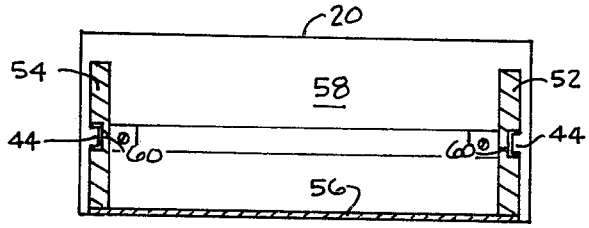
FIG. 4 is a cross sectional view of the drawer taken along line 4—4 of FIG. 3 and illustrating the channel members recessed within grooves provided within the side walls.
Figure 5:
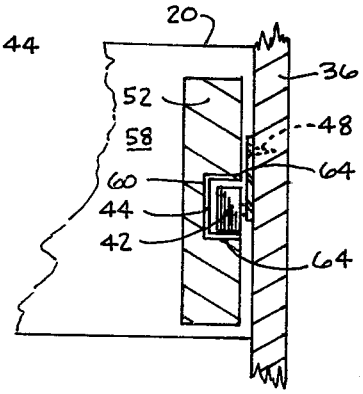
FIG. 5 is a fragmentary view in vertical cross section taken along line 5—5 of FIG. 3.

The drawers include a rear wall 50, side walls 52, 54, a bottom 56 and a front 58, all secured together in a conventional manner. Each side wall 52 and 54 is provided with a groove 60 which extends the full length thereof, see FIG. 3. As shown in FIGS. 4 and 5, each groove 60 has a depth to substantially receive therein a channel member 44 having a generally C-shaped cross section. In the embodiment illustrated, the depth of the groove is approximately one-half of the thickness of a drawer side wall, and approximately equal to the depth of the channel member. Recessing the channel members on each side of the drawer, rather than securing the channel members to the outer surfaces of the side walls, permits an increase in the effective drawer width. The channel members may be glued or otherwise suitably secured within the recesses 60.

As shown in FIG. 5, the rollers 42 substantially correspond in width to the width of the channel flanges 64 and ride upon the upper or lower flanges of the C-shaped channel members, depending upon whether the drawer is opened or closed, and prevent the drawers from tilting out of the desk.

Figure 3:
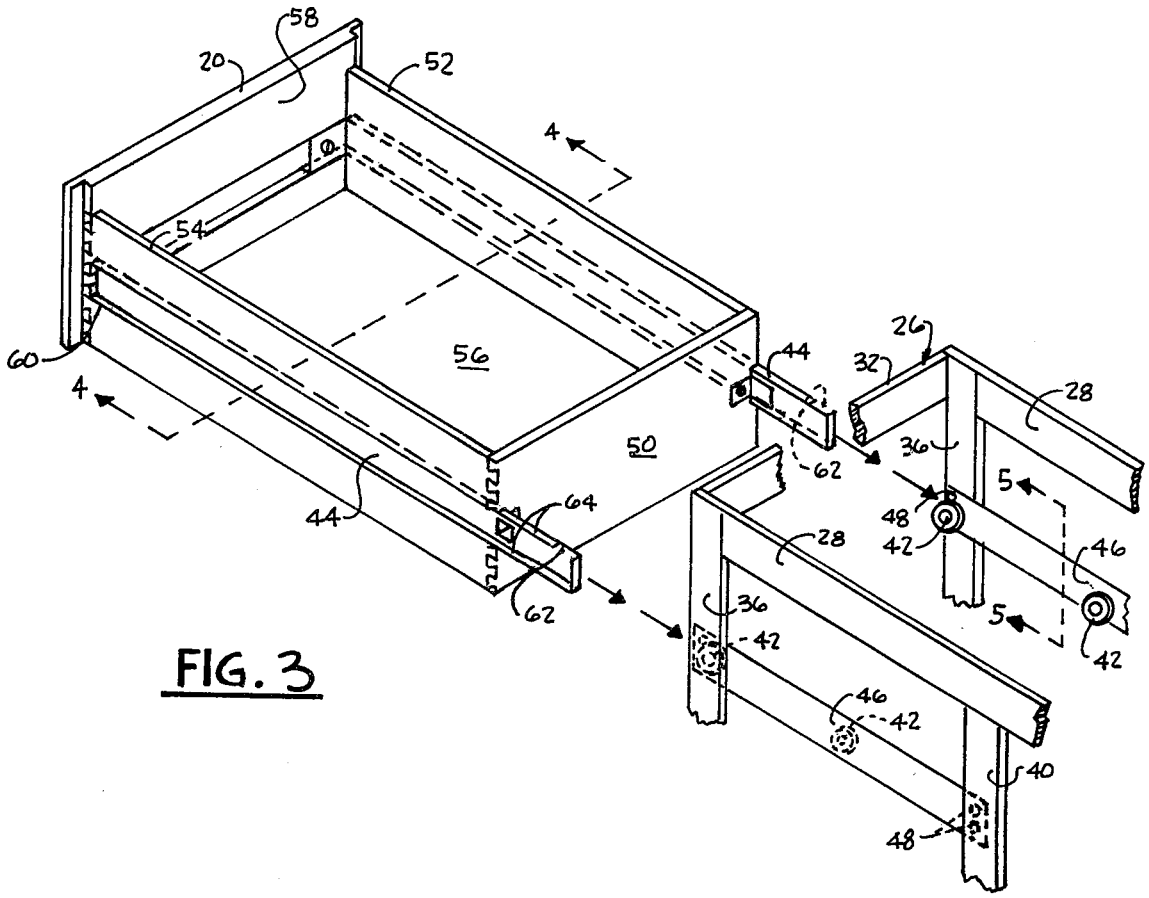
FIG. 3 is a fragmentary, perspective view of a drawer extended beyond the desk and illustrating the installation of the channel members and the roller support plates.

It is to be noted that the channel members 44 extend a substantial distance beyond the rear wall 50, as shown by FIG. 3. This provides for extra travel of the drawer outwardly of the desk and unobstructed access to the rear portion of the drawer. A porton of each channel member is turned upwardly, as at 62, for abutting the rearmost roller 42 adjacent a stretcher 40 to limit travel of the drawer outwardly of the cabinet structure.

Although a specific embodiment of a suspension assembly of this invention has been described, modifications may be made while retaining some or all of the benefits and advantages of the invention.

What is claimed is:

1. In a suspension system for supporting a drawer from a cabinet structure wherein the drawer includes side walls defining elongated, longitudinally extending grooves therein and front and rear walls, and the cabinet structure includes a plurality of horizontally spaced, vertically disposed members, first support means recessed within and secured to said drawer side walls, and second support means secured to said cabinet structure and cooperating with said first support means, said first support means including a track member recessed within each groove and secured to and extending longitudinally of each of said drawer side walls, each said track member including an elongated channel member having a substantially C-shaped cross-section, the depth of each groove substantially corresponding to the thickness of a track member received therein such that the outermost surfaces of the track member are substantially flush with the outermost surfaces of a drawer side wall, and said second support means including generally horizontally disposed, spaced mounting plates, secured to selected vertically spaced members of said cabinet structure, each said plate including a flat, relatively thin, elongated member positioned in a vertical plane and extending generally longitudinally of said drawer side walls, said recessed track members of said flat, thin mounting plates permitting minimum spacing between said drawer side walls and said cabinet structure thereby permitting use of drawers of increased width, a plurality of horizontally spaced rollers fixedly secured to each said mounting plate and received within each said side wall recess and positioned for rolling engagement within a track member upon displacement of the drawer, said cabinet structure including a framework defined by horizontally disposed, parallel, top and bottom side rails and top and bottom end rails secured to said vertically disposed members, said vertically disposed members comprising spaced, parallel, front and rear vertical rails and vertically extending stretchers intermediate said front and rear vertical rails, and wherein said mounting plates have end portions secured to said vertical front rails and stretchers, respectively, and wherein a plurality of horizontally spaced rollers are mounted upon each said plate, one roller being secured adjacent a vertical front rail and a second roller being secured substantially midway between a vertical front rail and a stretcher.

2. A suspension system as recited in claim 1 wherein each said track member extends rearwardly of the drawer rear wall a substantial distance to permit maximum displacement of the drawer outwardly of said cabinet structure, said track member further including stop means to limit inadvertant removal of the drawer from the cabinet structure.

3. A suspension system as recited in claim 2, wherein the channel members are adhesively secured within the grooves of said drawer side walls.

* * * * *